United States Patent [19]

Golla

[11] 4,049,529

[45] Sept. 20, 1977

[54] APPARATUS WITH CRUST PIERCING AND GAS FEEDING MEANS FOR USE WITH ELECTROLYTIC FURNACES

[75] Inventor: Franz Golla, Lunen, Germany

[73] Assignee: Gewerkschaft Eisenhutte Westfalia, Lunen, Germany

[21] Appl. No.: 703,947

[22] Filed: July 9, 1976

[30] Foreign Application Priority Data

July 10, 1975 Germany ..... 2530831

[51] Int. Cl.[2] ..... C25C 3/14; C25C 7/00

[52] U.S. Cl. ..... 204/246; 204/245; 204/279

[58] Field of Search ..... 204/243 R–247, 204/67, 279

[56] References Cited

U.S. PATENT DOCUMENTS

| | | | |
|---|---|---|---|
| 3,207,681 | 9/1965 | Sem | 204/247 X |
| 3,551,308 | 12/1970 | Capitaine et al. | 204/246 X |
| 3,681,229 | 8/1972 | Lowe | 204/246 X |
| 3,901,787 | 8/1975 | Niizeki et al. | 204/245 |
| 3,977,950 | 8/1976 | Tortil | 204/246 X |

*Primary Examiner*—John H. Mack
*Assistant Examiner*—D. R. Valentine
*Attorney, Agent, or Firm*—Charles E. Pfund

[57] ABSTRACT

An apparatus is arranged over the bath of an electrolytic furnace containing molten aluminium.

The apparatus has beams with tools which can be raised and lowered in a reciprocal manner to break-up the crust which forms on the top of the molten aluminium. Reservoirs containing alumina are also carried by the beams and serve to selectively charge quantities of alumina into the bath. Probes or lances are extendible and retractible in relation to the beams and serve to inject air into the molten aluminium.

7 Claims, 3 Drawing Figures

APPARATUS WITH CRUST PIERCING AND GAS FEEDING MEANS FOR USE WITH ELECTROLYTIC FURNACES

BACKGROUND OF THE INVENTION

In the production of aluminium with an electrolytic furnace it is desirable to preclude the so-called anode effect by injecting a gas, usually air, into the molten aluminium. To achieve this it is known to break up the crust which forms on the top of the molten aluminium and then to use manually-operated probes or lances to blow air into the molten aluminium thus exposed. From German patent specification No. 1608232 it is known also to constructionally unite the lances with the crust-breaking tools in an apparatus mounted over the bath containing the molten aluminium. The present invention relates to an apparatus of this type and has as its object the provision of improvements to the apparatus.

SUMMARY OF THE INVENTION

The present invention is based upon the realization that it is desirable to control and operate the breaking tools and the gas-injecting lances independently while still providing a simple reliable construction.

In one aspect the invention provides in an apparatus used with an electrolytic furnace for producing aluminium; said apparatus being generally disposed over a bath containing molten aluminium and comprising means for breaking-up the crust which forms on the molten aluminium during use, means for raising and lowering the breaking means to effect the breaking up of the crust and nozzle means for injecting gas into the molten aluminium; the improvement comprising mounting the nozzle means on the breaking means and providing means for independently raising and lowering the nozzle means in relation to the breaking means.

In another aspect the invention provides apparatus for use with an electrolytic furnace producing aluminium; said apparatus comprising at least one tool-carrying means disposed above a bath of the furnace containing molten aluminium, means for raising and lowering said tool-carrying means to break up the crust formed on the molten aluminium during operation of the furnace, nozzle means for discharging gas carried by said tool-carrying means and means for raising and lowering said nozzle means in relation to the tool carrying means whereby the nozzle means can inject gas into the molten aluminium.

It is preferable to have the tool-carrying means arranged so that it can be raised and lowered between end and intermediate positions. This then enables the crust-breaking operation to be achieved by a comparatively small reciprocal stroke of the relatively heavy tool-carrying means. The injection of gas by the nozzle means into the molten aluminium can be carried out independently of the crust breaking operation and usually these operations would be carried out successively although they can be carried out simultaneously. The nozzle means, which can be in the form of one or more probes or lances with apertures therein can be retracted or extended in relation to the tool-carrying means as desired. The discharge of gas, usually air, can take place while the nozzle means is actually being raised or lowered.

In one constructional form the means for raising and lowering the nozzle means can comprise at least one piston and cylinder unit having a piston rod extending through its cylinder, the piston rod being hollow to permit the passage of gas to the nozzle means. The unit for effecting movement of the nozzle means can be fitted to the tool-carrying means, i.e., the breaking means. The nozzle means can then be detachably coupled to the lower end of the hollow piston rod by means of a press-type fitting or a bayonet fitting.

Any suitable form of control means can be provided to facilitate the operation of the apparatus. When the tool-carrying means has descended sufficiently for the tool or tools to break open the crust on the surface of the molten aluminium in the electrolytic bath a switch of the control means can be actuated to initiate the upward movement of the tool-carrying or breaking means. The control means can be constructed to enable the breaking means to automatically cycle up and down a certain number of times during the breaking operation. With a view to making the breaking means only move through a short distance it is desirable for this cyclic movement to occur between an intermediate position and a lower position whereat the tool or tools penetrate the crust. This intermediate position can then be below an upper initial position for the breaking means. The control means may also enable the gas-blowing operation to take place after the tool-carrying means has been lowered under manual control to a position wherefrom the nozzle means can be lowered into the molten aluminium. The supply of pressurized air or other gas to the nozzle means can be initiated automatically prior or during the lowering of the nozzle means. The supply of pressurized air can be controlled by magnetic or other valves and a timer may be used to determine the time for which the air is discharged from the nozzle means. A throttle can be used to vary the flow rate of the air so that in its lowest position the nozzle means discharges the maximum quantity of air. A switching action initiated by the timer may cause the nozzle means to be raised with the air throttled gradually until the flow ceases, for example, in the upper retracted position of the nozzle means. The control means may then initiate raising of the tool-carrying means back to its uppermost rest position. As with the breaking operation the blowing operation may be effected in a cyclic manner by raising and lowering the nozzle means several times. The control means may be adapted to automate the breaking and blowing operations completely with manual control of the number of breaking and/or blowing cycles and the duration of the blowing time.

In accordance with a further preferred feature of the invention, one or more reservoirs may store alumina for charging into the electrolytic bath. One or more hoppers fed by the or each reservoir can be carried by the breaking means and preferably valve means is provided to regulate the quantity of alumina fed into the bath. The aforementioned control means can incorporate a timer which initiates lowering of the breaking means after the breaking operation has taken place and which then enables the aluminium oxide to be fed in a predetermined quantity into the bath.

The breaking means may comprise one or more beams to which tools are detachably fitted and nozzle means may be provided in gaps between the tools. Preferably guides are then provided to guide the movement of the nozzle means.

The invention may be understood more readily, and various other features of the invention may become more apparent, from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
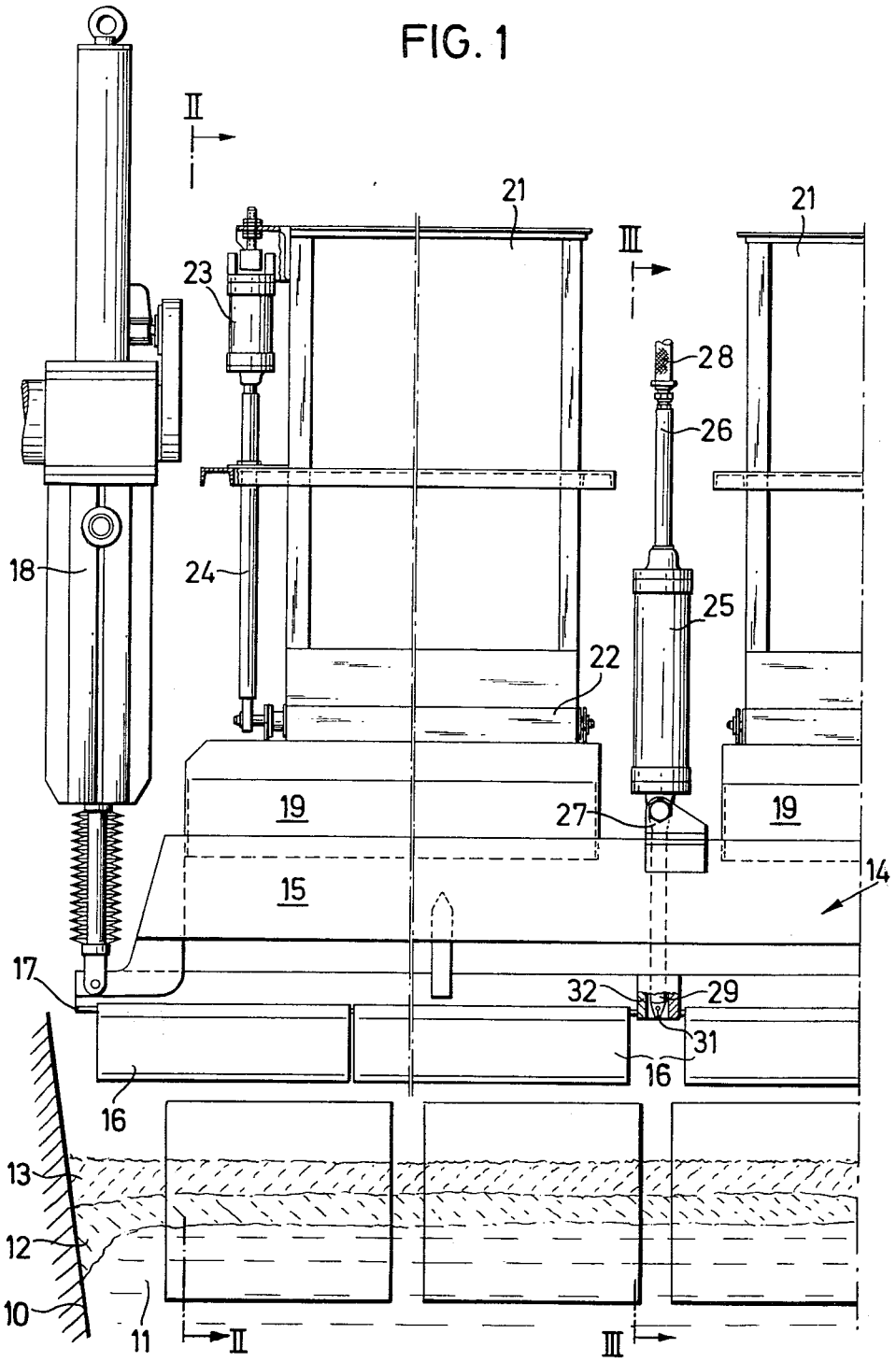
FIG. 1 is a schematic elevation of apparatus made in accordance with the invention together with part of the associated electrolytic furnace.

In the drawings, the reference numeral 10 denotes the bath of an electrolytic furnace used in the production of aluminium in generally known manner.

The bath 10 which can be divided into a plurality of individual cells or compartments containing molten aluminium is formed by insulated brickwork or the like provided with an internal cathodic lining of carbon. A number of carbon anodes K are located at the upper region of the interior of the bath 10. The molten aluminium in the bath 10 is denoted by reference numeral 11 and the upper electrolyte layer of the aluminium is denoted by reference numeral 12. A solid crust 13 forms on the upper layer 12 and the apparatus which will now be described serves to break open the crust 13 to permit the introduction of air and the charging-in of fresh aluminium oxide or alumina.

Figure 2:
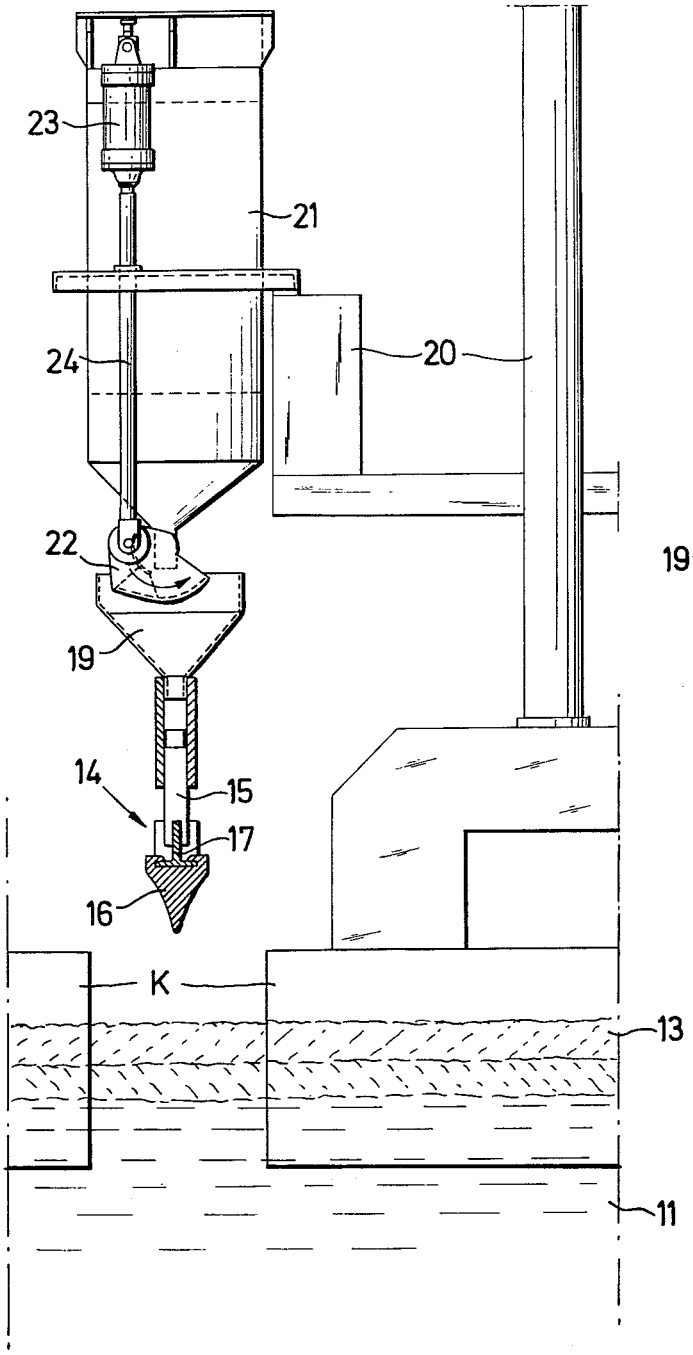
FIG. 2 is a schematic part-sectional end view of the apparatus, the view being taken in the direction of arrow II—II in FIG. 1.

The apparatus made in accordance with the invention is generally supported on the frame of the furnace and inter alia is provided with means 14 for breaking open the crust 13. This breaking means 14 comprises one or more beams 15 carrying tools 16. The beams 15 are at least partly hollow and can each be composed of two parallel spaced-apart plates. Conveniently, the tools 16 are easily replaceable and are formed as castings. As shown in FIG. 2, this can be achieved by providing a T-shaped strip 17 at the lower edge of each beam 15 and by forming the associated tool 16 with a slotted recess designed to enable the tool 16 to mate and slide over the lower transverse flange of the strip 17 in the manner of a tongue-and-groove connection. The breaking means 14, i.e., the beams 15 and tools 16, is collectively movable in the vertical sense and lifting means 18 is provided to raise and lower the breaking means 14. This lifting means 18 can be in the form of mechanical spindle type devices or hydraulic or pneumatic devices provided at the ends of the beams 15 and operated by control means (not shown). This control means preferably includes timers, valves, one or more drive motors and limit switches directly or indirectly actuated by the beams 15.

As shown in FIGS. 1 and 2, several hoppers 19 are secured to the tool carrying means, i.e., the beams 15 and above these hoppers 19 there are reservoirs 21 for containing alumina. The reservoirs 21 are carried by the framework 20 of the furnace (FIG. 2) and communicate with the hoppers 19 via adjustable valve devices 22 which serve to control the quantity of alumina passed into the hoppers 19. The devices 22 are in the form of pivotable shovel-like flaps which are moved with the aid of pneumatic piston and cylinder units 23 secured to the reservoirs 21 and having piston rods 24 linked to the flaps 22. The devices 22 can thus be operated by the units 23 to generally control the quantity of aluminium oxide fed into the hoppers 19 and hence charged into the furnace 10. More particularly, the devices 22 each takes up a quantity of alumina and discharges this quantity into the associated hopper 19 when the associated unit 23 operates.

Figure 3:
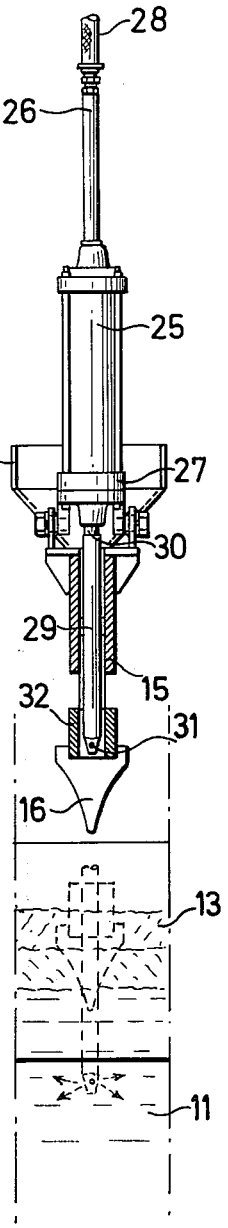
FIG. 3 is a schematic part-sectional end-view of the apparatus, the view being taken in the direction of arrow III—III in FIG. 1.

The apparatus also employs means for introducing or injecting air into the molten aluminium 11. This means takes the form of pneumatic piston and cylinder units 25 (FIGS. 1 and 3) each having a piston rod 26 extending through its cylinder and projecting from both ends. The cylinder of each unit 25 is connected with a bracket 27 to one of the beams 15. The rod 26 of each unit 25 is hollow and a compressed air supply is connected by way of a conduit 28 to the upper end of each piston rod 26. At its lower end each rod 26 is fitted with a nozzle means in the form of a blowing lance 29 which may be a tube with one or more openings 31 at its lower end. Conveniently, the lances 29 are connected to the rods 26 with the aid of quick-release couplings 30 such as a push-type or bayonet-type coupling. The individual lances 29 extend through the beams 15 or the hollow parts of the beams 15 and guide means 32 serves to guide the lances 29 for vertical movement within the beams 15. The lances 29 are disposed between the tools 19 so that by operating the units 25 the lances 29 can be lowered or raised between the tools 16. The operation of the apparatus is as follows:

In order to break-up the crust 13, the lifting means 18 is operated by the control means to lower the breaking means 14, i.e., the beams 15. The tools 16 then pierce the crust 13 — as represented by chain lines in FIG. 3. Limit switches or the like are actuated when the tools 16 penetrate the crust 13 to the desired extent and thereby the beams 15 are raised until further limit switches or the like halt the upward motion. Instead of performing a single cycle the control means may enable several cycles of movement of the beams 15 to be performed to thereby successively drive the tools 16 through the crust 13. The beams 15 could then move up and down through a somewhat smaller distance with the beams 15 being returned to an intermediate uppermost stroke position lower than the normal initial upper position. When the breaking operation has been completed the beams 15 are raised to the initial upper position and after a predetermined time, say 10 minutes, the control means can initiate the next operating stage in which the bath 10 is charged with aluminium oxide from the reservoirs 21. During this operating stage, the beams 15 are again lowered but the downward motion is halted at the aforementioned intermediate position. At this point the units 23 are charged to pivot the devices 22 downwardly to thereby eject the alumina stored therein into the hoppers 19 and thence into the molten aluminium 11 via the broken crust 13. After a predetermined time the control means again actuates the units 23 to bring the devices 22 back to the position where they accept fresh alumina from the reservoirs 21 and the beams 15 are again raised. Again, instead of merely performing one charging cycle the units 23 can be operated several times to cause batches of alumina to be charged into the furnace 10.

When it is desired to inject air into the molten aluminium 11 to preclude the anode effect the beams 15 are again lowered to the lowermost position where the tools 16 penetrate the crust 13. The units 25 are then charged to lower the lances 29 into the molten aluminium 11 as indicated by the chain-dotted lines in FIG. 3. The control means then actuates a valve to permit air to pass along the rods 26 to discharge from the lances 29 and into the molten aluminium 11. After a pre-determined time the air flow is blocked and the lances 29 are raised and retracted into the beams 15 by means of the units 25. It is possible to control the air flow to enable a reduced quantity of air to be discharged by the lances 29 as these are raised through the aluminium 11 and to block the air flow when the lances 29 are raised to a pre-determined position. The lances 29 can be raised and lowered and air blown into the aluminium 11 several times before the beams 15 are again raised.

The apparatus enables the various operations described to be achieved efficiently and more or less independently. Any or all of the main operations, i.e., the breaking operation, the alumina-charging operation and the air-blowing operation can be initiated manually or automatically as described.

Various modifications can be made to the apparatus without departing from the general scope of the invention.

I claim:

1. Apparatus for use with an electrolytic furnace producing aluminium; said apparatus comprising at least one tool-carrying means disposed above a bath of the furnace containing molten aluminium, means for raising and lowering said tool-carrying means to break up the crust formed on the molten aluminium during operation of the furnace, nozzle means for discharging gas carried by said tool-carrying means and means for raising and lowering said nozzle means in relation to the tool carrying means whereby the nozzle means can inject gas into the molten aluminium.

2. An apparatus according to claim 1, wherein the means for raising and lowering said nozzle means comprises at least one piston and cylinder unit having a piston rod extending through its cylinder, the piston rod being hollow to permit the passage of gas to the nozzle means.

3. An apparatus according to claim 2, wherein the nozzle means is detachably coupled to said piston rod.

4. An apparatus according to claim 1, wherein there is provided a guide for guiding the nozzle means for movement in relation to the tool carrying means.

5. An apparatus according to claim 1, wherein there is further provided at least one hopper mounted to the tool-carrying means and means for selectively discharging alumina from the hopper into the bath.

6. An apparatus according to claim 1, wherein the tool-carrying means comprises at least one beam provided with a mounting for detachably securing tools thereto, the tools being spaced apart with the nozzle means being located between the tools.

7. In an apparatus used with an electrolytic furnace for producing aluminium; said apparatus being generally disposed over a bath containing molten aluminium and comprising means for breaking-up the crust which forms on the molten aluminium during use, means for raising and lowering the breaking means to effect the breaking up of the crust and nozzle means for injecting gas into the molten aluminium; the improvement comprising the nozzle means mounted on the breaking means and means for independently raising and lowering said nozzle means in relation to said breaking means.

* * * * *